US006883802B2

(12) United States Patent
Rom

(10) Patent No.: US 6,883,802 B2
(45) Date of Patent: Apr. 26, 2005

(54) PUZZLE

(75) Inventor: Dror Rom, Huntingdon Valley, PA (US)

(73) Assignee: Prosoft Software, Inc., Wayne, PA (US)

( * ) Notice: Subject to any disclaimer, the term of this patent is extended or adjusted under 35 U.S.C. 154(b) by 51 days.

(21) Appl. No.: 10/439,166

(22) Filed: May 14, 2003

(65) Prior Publication Data

US 2004/0000756 A1 Jan. 1, 2004

Related U.S. Application Data

(60) Provisional application No. 60/391,808, filed on Jun. 26, 2002.

(51) Int. Cl.[7] ..... A63F 9/08

(52) U.S. Cl. ..... 273/153 S; 273/155

(58) Field of Search ..... 273/153 R, 155, 273/153 S, 157 R

(56) References Cited

U.S. PATENT DOCUMENTS 4,548,411 A * 10/1985 Seidman ..... 273/153 R
4,881,738 A * 11/1989 Ayers ..... 273/153 S
5,100,142 A * 3/1992 Cannata ..... 273/155
5,301,943 A * 4/1994 Asztalos ..... 273/153 S
5,370,394 A * 12/1994 Huncaga ..... 273/153 S
5,628,512 A * 5/1997 Chan ..... 273/153 S
6,386,540 B1 * 5/2002 Stevkovski ..... 273/153 S

* cited by examiner

*Primary Examiner*—Steven Wong
(74) *Attorney, Agent, or Firm*—Design IP

(57) ABSTRACT

The invention comprises a puzzle including elements arranged in rows and columns, each element being rotatable about first and second perpendicular axes. The first axis of each element is parallel and co-planar to the first axes of every other element. Similarly, the second axis of each element is parallel and co-planar to the second axes of every other element. The puzzle also preferably includes a case that restrains non-rotational movement of each element and a linkage that forces rotation of all other elements in any one row to rotate about their respective first axes when any one of the elements in that row is rotated about its first axis. The linkage also forces rotation of all elements a column to rotate about their respective second axes when any one of the elements in that column is rotated about its second axis.

17 Claims, 8 Drawing Sheets

PUZZLE

This application claims benefit of U.S. Provisional 60/391,808 filed Jun. 26, 2002.

BACKGROUND

The present invention relates to puzzles.

A wide variety of puzzles and puzzle devices are available, including both mechanical and electronic puzzles. In such puzzles, the user manipulates the puzzle to achieve a desired result or to solve a problem. The well-known Rubik's Cube is an example of such a puzzle, wherein the user is required to rotate portions of a cube that are each made up of smaller cubes having differently colored sides. The objective of Rubik's Cube is to manipulate the cube in a matter that results in a desired design of colors, the simplest being a single color on each side of the cube. The present invention is a unique and innovative puzzle from this field of the art.

SUMMARY OF THE INVENTION

The invention comprises a puzzle including elements arranged in at least one row and at least one column. Each of the elements is rotatable about a first axis and a second axis. The first axis of each element is parallel and co-planar to the first axes of every other element. Similarly, the second axis of each element is parallel and co-planar to the second axes of every other element. The first and second axes of each element are preferably perpendicular to each other. The puzzle also includes a case that restrains non-rotational movement of each element and a linkage that forces rotation of all other elements in any one row to rotate about their respective first axes when any one of the elements in that row is rotated about its first axis. The linkage also forces rotation of all elements a column to rotate about their respective second axes when any one of the elements in that column is rotated about its second axis.

BRIEF DESCRIPTION OF THE DRAWINGS

The following detailed description of the preferred embodiments of the invention will be better understood when read in conjunction with the appended drawings. For the purposes of illustrating the invention, there is shown in the drawings embodiments which are presently preferred. It is understood, however, the invention is not limited to the precise arrangements and instrumentalities shown in the drawings.

DETAILED DESCRIPTION OF THE PREFERRED EMBODIMENTS

Figure 1:
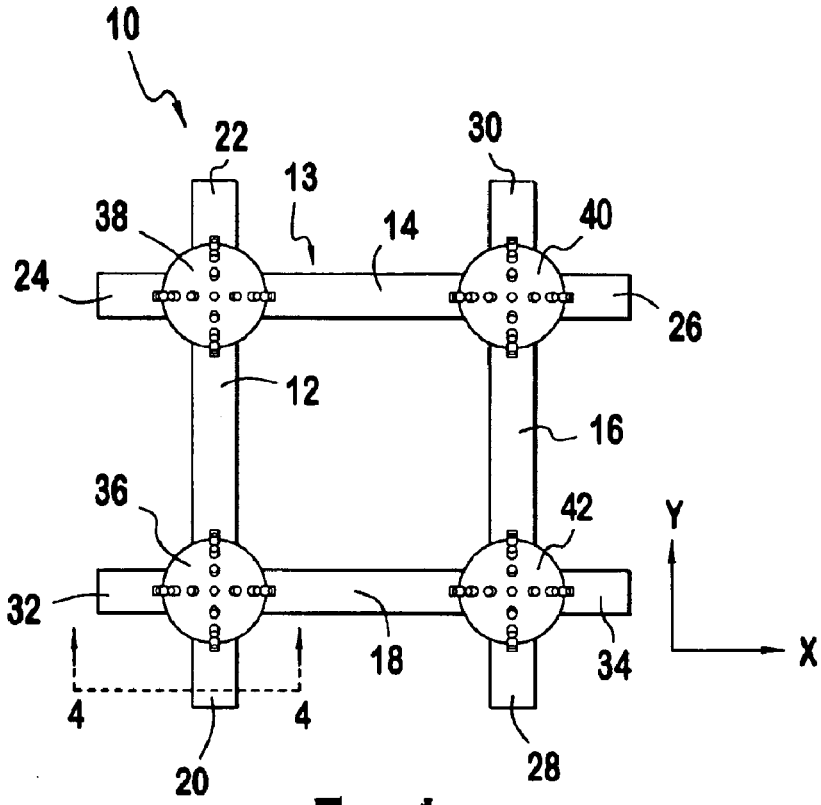
FIG. 1 is a top view of a preferred embodiment of a puzzle according to the present invention.

The present invention is a puzzle that can be implemented in a wide variety of structures and formats. The essence of the invention is a puzzle having a plurality of puzzle elements, each puzzle element having a different design or color on each of six faces. Each puzzle element can be rotated in either two or three orthogonal axis, but is preferably restrained against non-rotational movement. In the case of a two-dimensional puzzle, each puzzle element is preferably rotatable about X and Y axes. In the case of a three-dimensional puzzle, each puzzle element will be rotatable about X, Y and Z axes. In addition, the puzzle elements are linked so that when a particular puzzle element is rotated, all other puzzle elements that are located in a plane that is perpendicular to the axis of rotation and passes through are forced to rotate in the same direction. The objective of the puzzle is to manipulate the puzzle elements so that a desired design is shown on the front of the puzzle, such as a single color.

The principles and operation of the puzzle according to the present invention are better understood with reference to the drawings and the accompanying description. In order to aid in understanding of the invention, reference numerals that are referred to in the specification with respect to one or more figures may appear in additional figures without a specific reference to such additional figure in the specification.

Referring now to FIG. 1, reference 10 generally refers to a puzzle in accordance with the present invention. The puzzle 10 shown in FIG. 1 is a two-dimensional embodiment of the present invention having four puzzle elements 36, 38, 40, 42 that are each secured to a portion of a frame 13 by any convenient means. The puzzle elements in this embodiment are shown as spheres or balls. In order to aid in describing the invention, the elements (or spheres) are identified herein as follows: lower left sphere 36, upper left sphere 38, upper right sphere 40 and lower right sphere 42. Although spheres provide for the simplest operation of the puzzle 10, other shapes could be substituted for the puzzle elements 36, 38, 40, 42, such as a cube or a hexahedron, for example.

Figure 2:
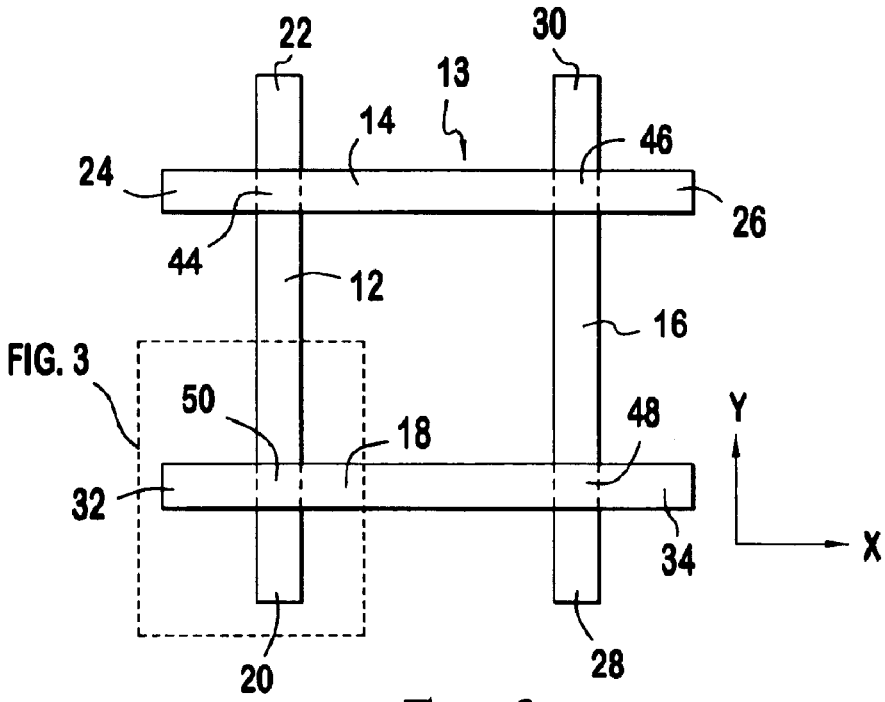
FIG. 2 is a top view of the puzzle shown in FIG. 1 wherein the balls have been removed.
Figure 3:
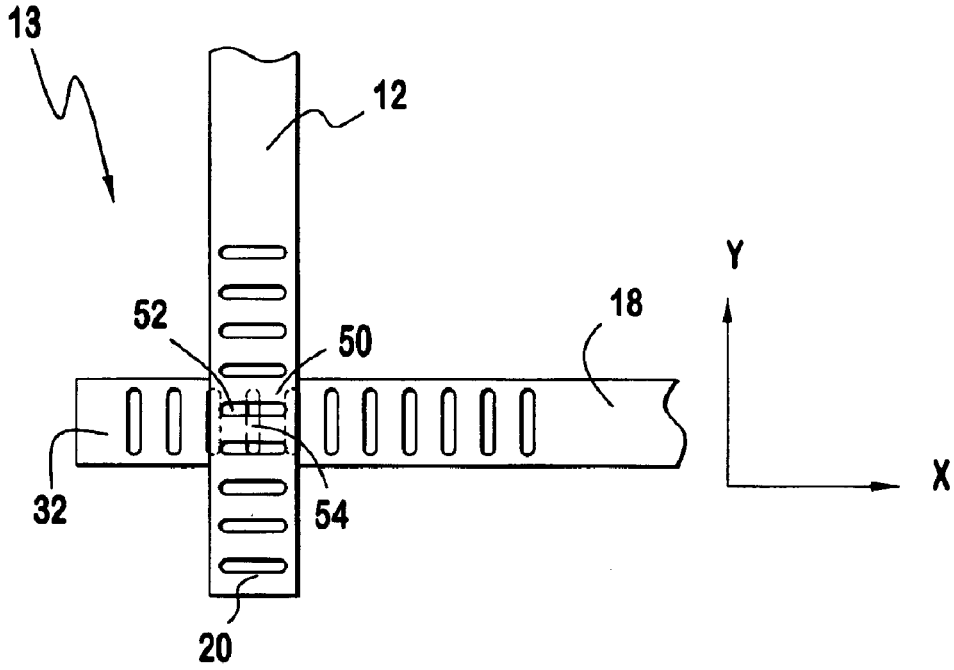
FIG. 3 is an enlarged top view of the area shown in dashed lines in FIG. 2.

Referring now to FIGS. 2–3, the frame 13 comprises two pairs of parallel bars left and right vertical bars 12, 16 and top and bottom horizontal bars 14, 18. Each of the bars 12, 14, 16, 18 can be slid in either direction along a single axis. The vertical bars 12, 16 can be slid up or down along the Y axis and the horizontal bars 14, 18 can be slid to the left or right along the X axis. As shown in FIG. 3, each bar includes a plurality of evenly spaced slots formed thereon. The vertical bar 12 shown in FIG. 3 includes elongated horizontal slots 52 and the horizontal bar 18 includes a plurality of elongated vertical slots 54.

Figure 4:
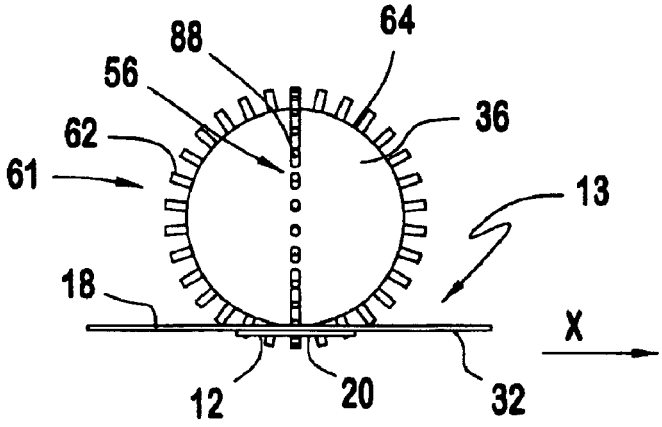
FIG. 4 is an enlarged front view of the area shown in dashed lines in FIG. 1.

Referring now to FIGS. 3 and 4, the slots 52, 54 operate in cooperation with two orthogonal arrays of pins 56, 60 protruding from the exterior 64 of the sphere 36. The length of the pins 58, 62 shown in FIG. 4 are exaggerated for clarity. In actuality, the pins 58,62 are just long enough to engage the slots 52, 54.

The operation of the puzzle 10 will now be described. Referring again to FIG. 1, the sphere 36 is rotated clockwise about the Y axis by pulling a tab 32, located on the left end of a lower horizontal bar 18, to the left. This motion would also rotate the lower right sphere 42 in a clockwise direction about the Y axis. Conversely counterclockwise rotation of the lower left sphere 36 is accomplished by pulling rightward on a tab 34 located on the right end of the lower horizontal bar 18. Rotation of the lower left sphere 36 about the Y axis is accomplished by pulling either the lower or upper tab 20, 22 of the left vertical bar 12. Such rotation in the Y axis would also cause the upper left sphere 38 to rotate in the same direction.

The movement and various configurations of the spheres 36, 38, 42, as well as other embodiments of the invention, can be described in relation to a type of mathematics called "group theory." In the context of a puzzle, such as puzzle 10, an "element" of the "group" is defined as a particular configuration of the spheres 36, 38, 40, 42. The objective of the present invention is to perform a series of operations, in this embodiment, rotational movements of the spheres 36, 38, 40, 42, that will cause the puzzle 10 to move from one element to another.

The group theory concept can be illustrated through an example in which the puzzle 10 is described in the context of two rows and two columns of spheres, since in the context of a two by two, two-dimensional puzzle, the rows and columns rotate together, depending upon whether a sphere is being rotated about the X or Y axis. Row 1 comprises the upper left sphere 38 and the upper right sphere 40. Row 2 corresponds to the lower left sphere 36 and the lower right sphere 42. Column 1 corresponds to the upper left sphere 38 and lower left sphere 36. Column 2 corresponds to upper right sphere 40 and lower right sphere 42. Operations are described in a short hand in which: 1r=roll Row 1 right-wise; 1rr=roll Row 1 right-wise twice; 1rrr=roll Row 1 right-wise three times; 1u=roll Column 1 up-wise; 1uu=roll Column 1 up-wise twice; 1uuu=roll Column 1 up-wise three times. Rolling any row or any column four times would result in no change because the same side would then be face forwarding again. The terms left-wise, right-wise, up-wise and down-wise correspond to the direction of motion of the portion of the sphere opposite the bars 12, 14, 16, 18.

Figure 5:
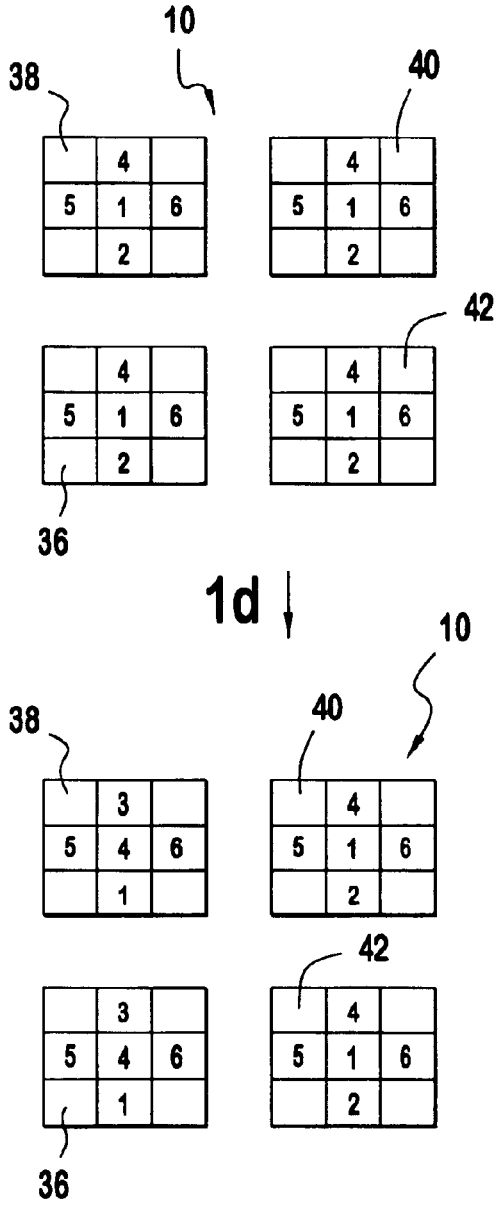
FIGS. 5–8 are schematic views of the puzzle in which the faces of the puzzle elements are numbered.
Figure 6:
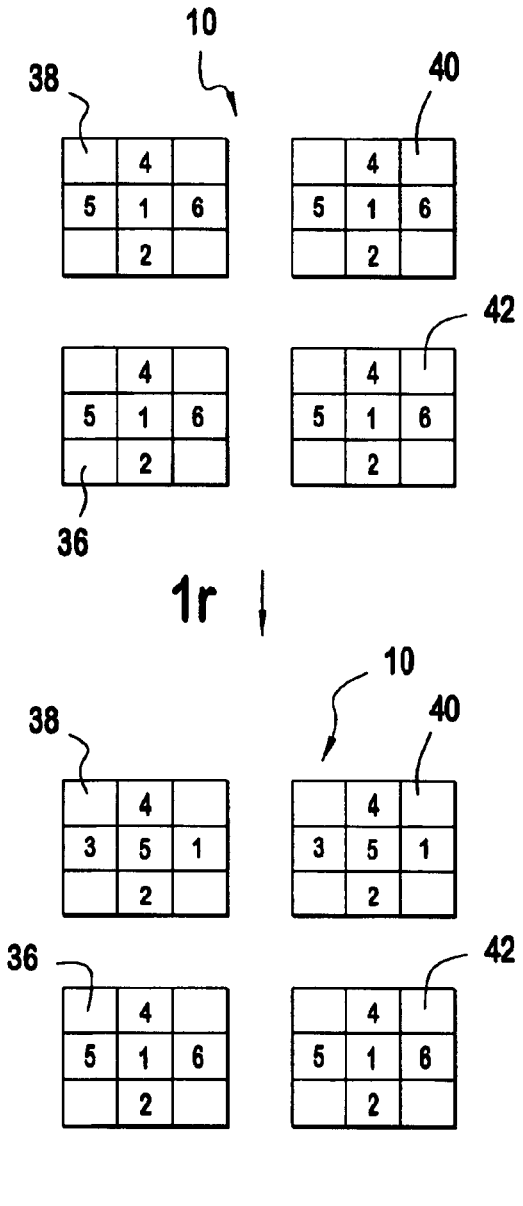
Figure 7:
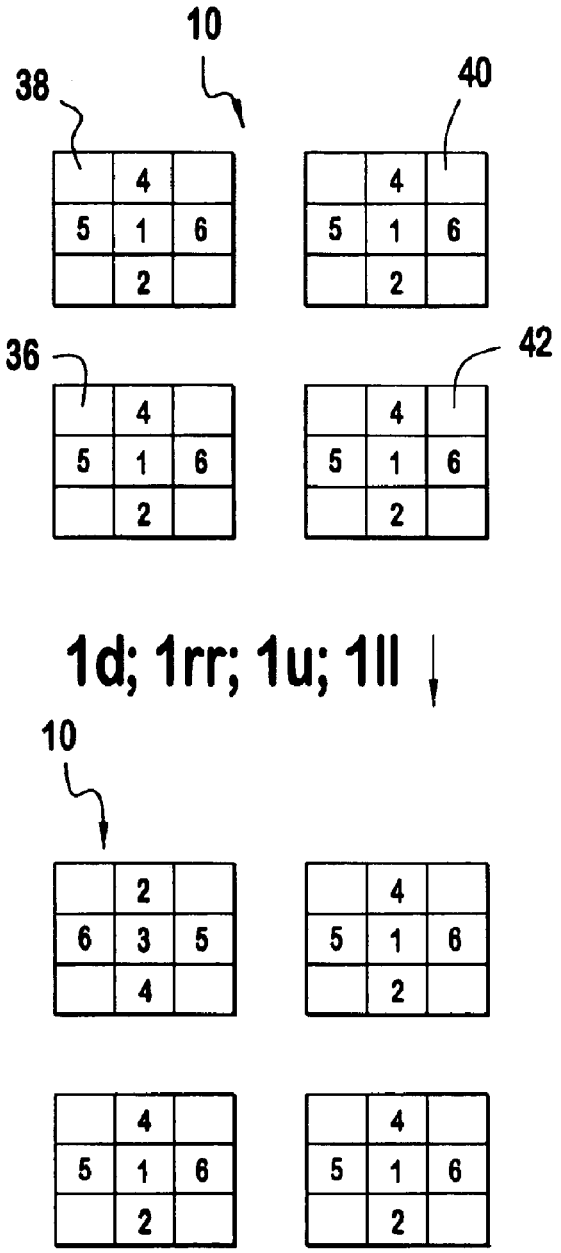
Figure 8:
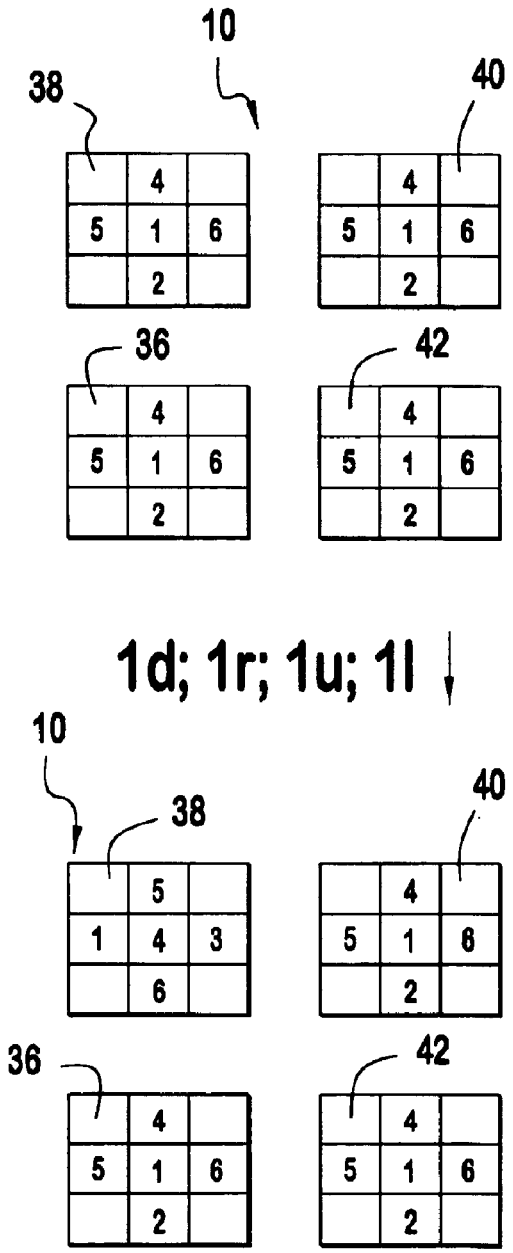

To further illustrate operation of the puzzle 10, each of the spheres is shown schematically in FIGS. 5–8 as a boxes with numbered faces. In FIG. 5, all four spheres 36, 38, 40, 42 have face number 1 facing outward. An operation is performed in which Column 1 is rotated downwardly once. This results in face number 4 facing forward in the upper left and lower left spheres 38, 40. In FIG. 6, the spheres 36, 38, 40, 42 begin in the same position as the first example and the operation is to move row 1 right-wise once. This results in face 5 facing forward in the upper left and upper right spheres 38, 40. In FIG. 7, a series of operations is performed. In this example, the spheres 36, 38, 40, 42 begin again with face 1 facing forward and the following operation is performed 1d; 1rr; 1u; 1ll. After these operations, the upper left sphere 38 is being turned upside down, which results in face 3 facing forward while all other spheres 36, 40, 42 remain unchanged. In FIG. 8, the spheres begin as described in the other examples, then the following operation is performed; 1d; 1r; 1u; 1l. This results in the upper left sphere 38 being rolled down and sideways (face 4 facing forward) while all other spheres 36, 40, 42 remain unchanged.

The foregoing represent merely a few examples of the operations that can be performed on the puzzle 10 to move from element to element.

Figure 9:
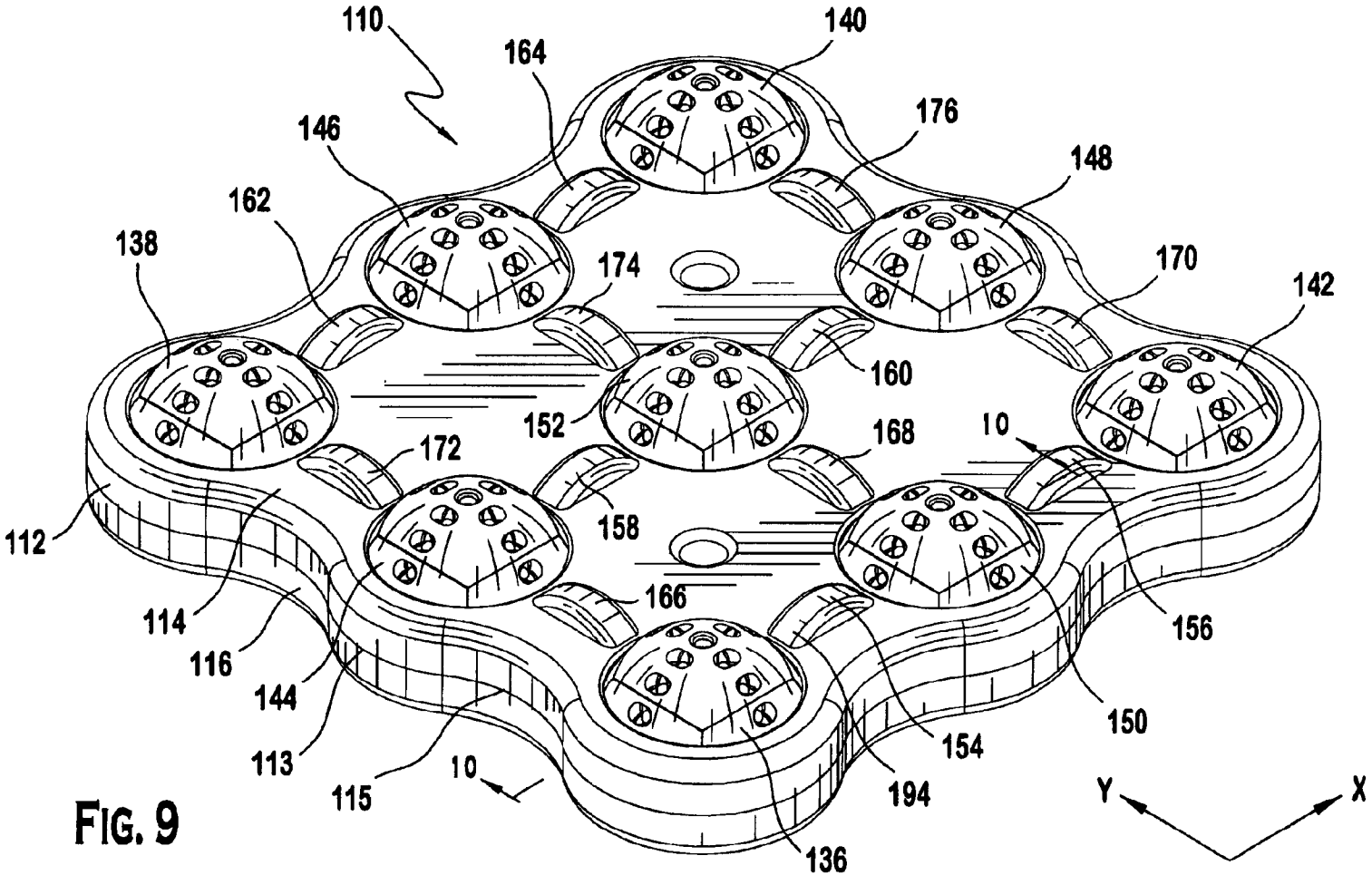
FIG. 9 is a perspective view of a second preferred embodiment of the present invention.

Referring now to FIG. 9, another preferred embodiment of the present invention is shown. This embodiment comprises a puzzle 110 that includes a three-by-three array (three rows and three columns) of spheres. The puzzle 110 is two dimensional, like puzzle 10, but shows a different structure for causing simultaneous rotation of all spheres in a row or column when any one of the spheres in that row or column is rotated, as well as a functional and attractive case 112 having top and bottom halves 114, 116.

The puzzle 110 includes four corner spheres 136, 138, 140 and 142, four side spheres 144, 146, 148 and 150, and a center sphere 152. The spheres are arranged in three rows and three columns and are retained in place by the case 112. The spheres protrude through the top and bottom halves 114,116 of the case 112 through top and bottom openings 178, 180, respectively (see FIG. 10). The vertical thickness of the case 112 and the size of the openings 114,116 are designed to maximize the portion of each sphere that protrudes from the case 112, while preventing the sphere from becoming dislodged from the case 112. In this embodiment, rotational motion of a sphere in response to the rotation of another sphere is caused by row gears 154, 156, 158, 160, 162, 164 and column gears 166, 168, 170, 172, 174, 176, which are located between the spheres and are fully contained within the case 112. For example gears 154 and 156 force spheres 136, 142 and 150 to rotate about the Y axis when any one of these three spheres is rotated about the Y axis by a user. Similarly, gears 158 and 160 force spheres 136, 144 and 138 to rotate about the X axis when any one of these three spheres is rotated about the X axis by a user.

Figure 11:
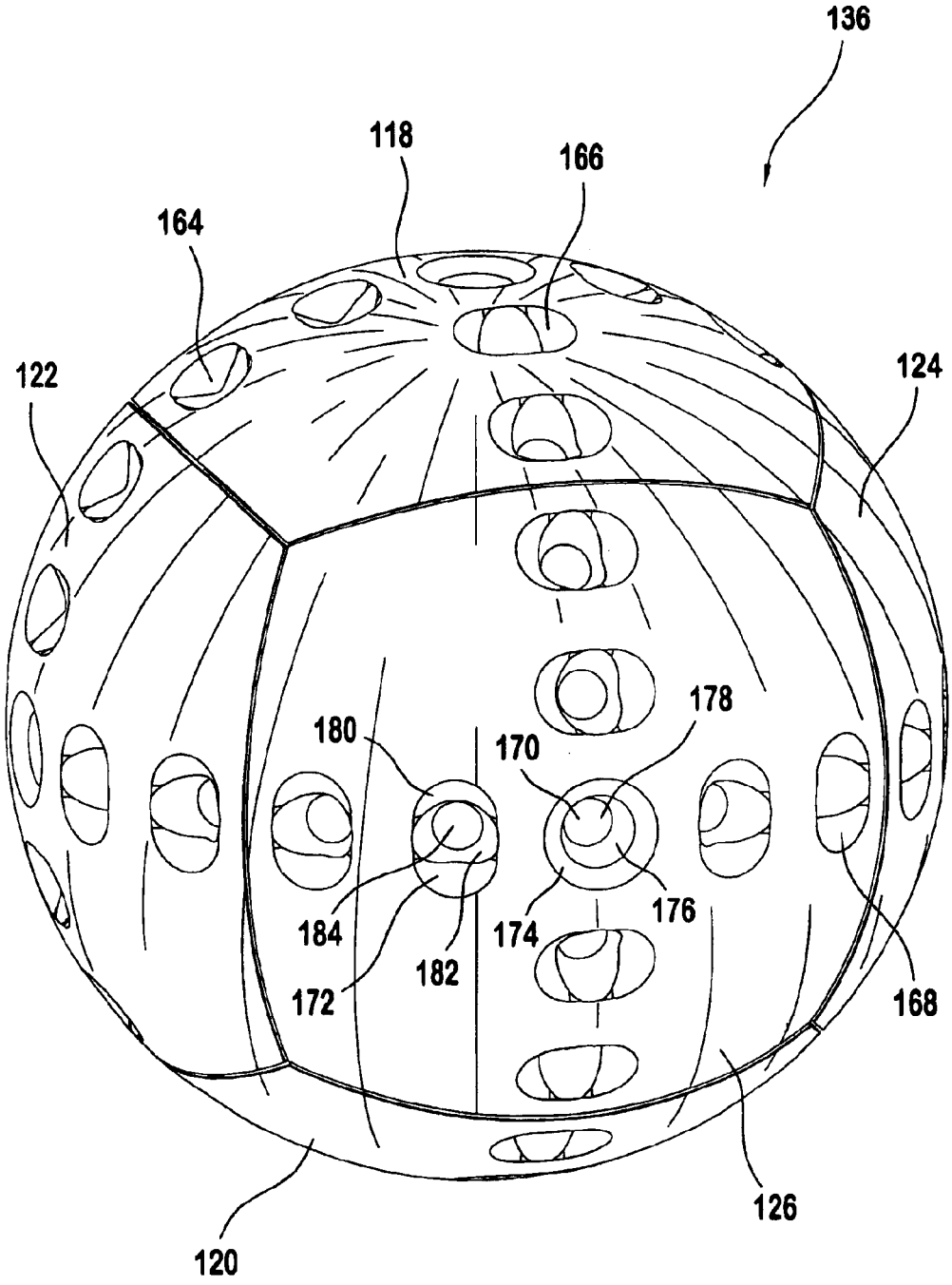
FIG. 11 is a perspective view of one of the spheres of the second embodiment of the present invention shown in an assembled state.
Figure 12:
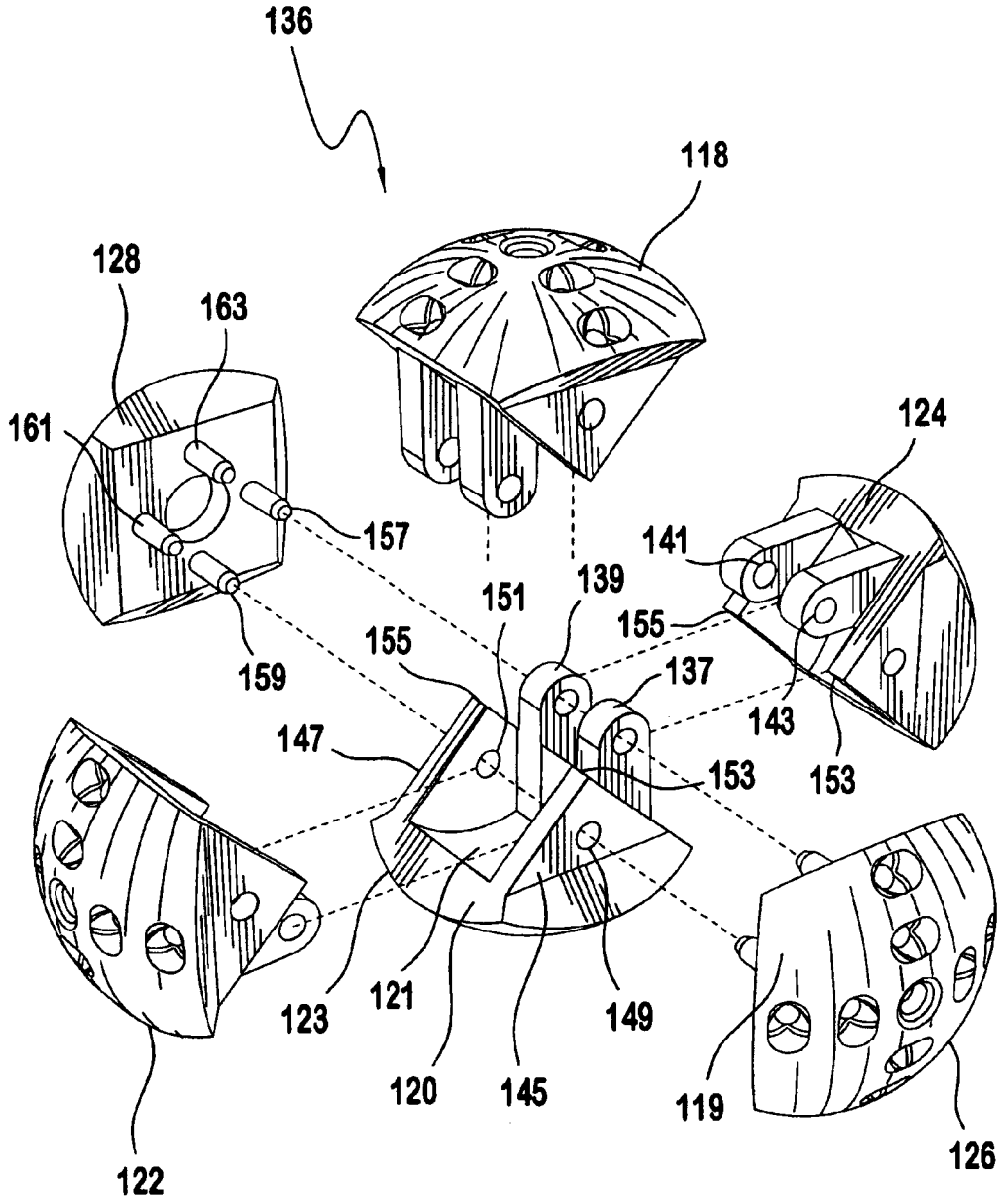
FIG. 12 is an exploded perspective view of the sphere shown in FIG. 11.

Referring now to FIGS. 11 and 12, the structure of one sphere 136 will be described in greater detail. All other spheres are identical in structure. Sphere 136 includes six interlocking parts: upper, lower, left and right quads 118, 120, 122, 124 and font and rear ends 126, 128. The six interlocking parts comprise some identical features, which are described in the following paragraph. In order to avoid clutter in the figure, these identical features are labeled only one part in which that feature is visible. It may be assumed that the feature is present in all other relevant parts.

Each interlocking part includes a convex face 119, which is shaped to form part of a spherical surface when the sphere is fully assembled (see FIG. 11). A deck 121 opposes the face 119. A tapered shoulder 123 provides the transition from the face 119 to the deck 121. In accordance with the present invention, each of the faces preferably has a different color or design shown thereon. The different colors or designs can extend through the entire part or be applied only to each face.

Each of the four quads 118, 120, 122, 124 include a pair of blades 137, 139 which are spaced apart, located at the edge of the deck 121 and extend inwardly. The blades of each respective quad are oriented so that that the blades nest when all four quads 118, 120, 122, 124 are assembled (see FIG. 1). Each of the blades 135, 137 includes a transverse hole 141, 143, respectively, near the end of the blade that is distal to the deck 121. Each quad also includes a pair of triangular bridges 145, 147, which are outboard of the blades. Each bridge 145, 147 extends to a vertex 153, 155. The vertexes of all of the quads 118, 120, 122, 124 meet along a single axis when the quads 118, 120, 122, 124 are assembled. The bridges 145, 147 each include a respective transverse hole 149, 151. The blade holes for each quad align with holes of the respective pair of bridges of the quad that is adjacent in the clockwise direction, forming a cylindrical locking channel. For example, a locking channel 165 (see FIG. 10) is formed by the holes in the blades of the left quad 122 and the holes in the bridges of the lower quad 120 when these two quads are assembled.

The front and rear ends 126, 128 each include four evenly-spaced pins 157, 159, 161, 163, which extend inwardly perpendicular to the deck 121. Each of the pins 157, 159, 161, 163 is preferably chamfered at the end distal to the deck 121, in order to aid in assembly. The pins 157, 159, 161, 163 are preferably sized to extend about half-way through a respective locking channel the so that the pins of the front end 126 meet the pins of the rear end 128.

Assembly of the sphere 136 is accomplished by first assembling the quads 118, 120, 122, 124, then inserting pins of the front and rear ends 126, 128 to lock the structure together. The pins provide a friction fit, but a small amount of adhesive (such as an epoxy resin or acrylic resin) is preferably used to increase durability and prevent separation of parts during use.

As shown in FIG. 1, each sphere includes three arrays 164, 166, 168 of co-planar holes that interact with the teeth on an adjacent gear to force rotation about the X or Y axis when an adjacent sphere is rotated. Each array of holes is perpendicular to the other two arrays. The arrays 164, 166, 168 comprise center holes 170, which are located at the intersection of two arrays. The remainder of the holes are field holes 172. As with spheres themselves, one center hole 170 and one field hole 172 are described below in detail. All other center holes are identical to the center hole 170 and all other field holes are identical to field hole 172.

Each center hole 170 includes a flared lip 174 that has a slightly concave shape and tapers sharply to a wall 176. The wall 176 tapers more gently to a bottom 178. The tapered lip 174 and wall 176 aid in guiding gear teeth 190 (see FIG. 10) into the center hole 170 if the sphere 136 floats out of alignment during rotation, which helps the puzzle 110 operate more smoothly. In order to facilitate engagement with the gear teeth 190 in either rotational direction, the lip 174 and wall 176 of the center hole 170 are symmetrical.

Similarly, field hole 172 includes a flared lip 180 that tapers sharply to a more gently-tapered wall 182 and terminates at a bottom 184. However, unlike the center hole 170, the field hole 172 is not symmetrical. Instead, the wall 182 is slightly elongated in the direction of rotation of the sphere when the field hole 172 is engaged by the gear (to create a larger "target" for the gear teeth) and the lip 180 is elongated in the opposite direction (to guide the sphere back into alignment when it drifts out of alignment).

It should be noted that many alternate internal structures could be used to form the spheres of the puzzle 110 without departing from the present invention. For example, each sphere could comprise a single-piece body having a colored insert for each of the six faces.

Figure 10:
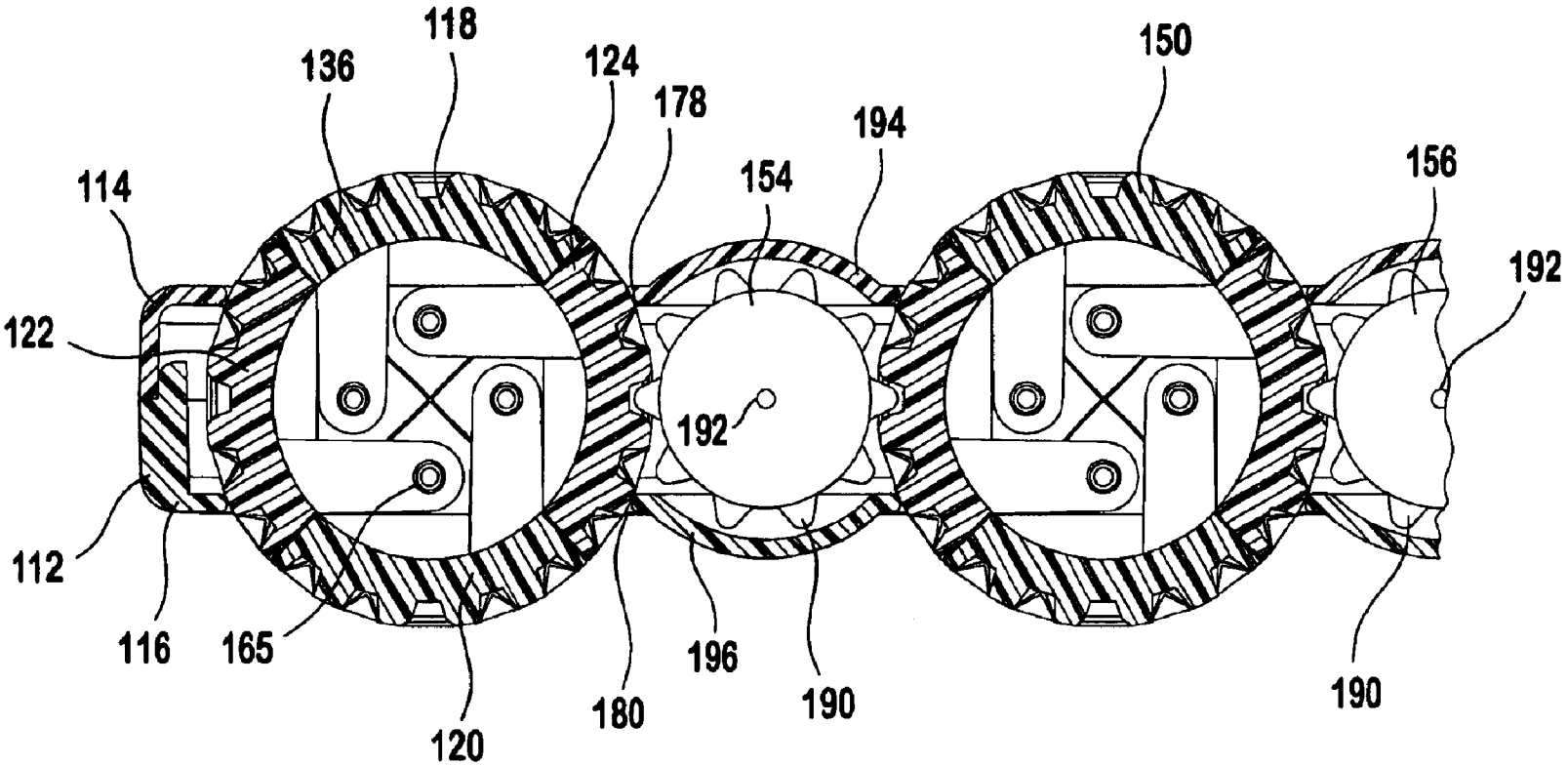
FIG. 10 is a cross-sectional view taken along line 10—10 of FIG. 9.

FIG. 10 shows the internal structure of the case 112 and the relationship between two spheres 136, 150 and a gear 154. The gear 154 includes a plurality of co-planer teeth 190 that engage the holes in the two spheres 136, 150. Each gear tooth 190 tapers as it extends outwardly from the gear 154 and is circular in cross-section in order to facilitate positive mechanical engagement with the sphere holes. The gear 154 is preferably held in position by an axle 192 and protected by upper and lower protruding portions 194, 196 of the case 112.

Alternate structures for the two puzzles 10 and 110 described above have yet to be developed but are within the skill of one with ordinary skill in the art.

It is recognized by those skilled in the art, that changes may be made to the above-described embodiments of the invention without departing from the broad inventive concept thereof. It is understood, therefore, that this invention is not limited to the particular embodiments disclosed but is intended to cover all modifications which are in the spirit and scope of the invention.

What is claimed is:

1. A puzzle comprising:

a plurality of elements arranged to define at least one row of elements and at least one column of elements, each of the plurality of elements being rotatable about a first axis and a second axis, the first axis of each of the plurality of elements being parallel to the first axis of every other of the plurality of elements, the second axis of each of the plurality of elements being parallel to the second axis of every other of the plurality of elements, each of the elements including first and second arrays of co-planar holes located on the outer surface of the sphere, the first array of co-planar holes being orthogonal to the second array of co-planar holes, the co-planar holes of each of the first and second arrays of co-planar holes comprising center holes located at an intersection of the first and second arrays of co-planar holes and field holes located along only one of the first and second arrays of co-planar holes;

a case that restrains non-rotational movement of each of the plurality of elements; and a linkage structure that forces all elements in the at least one row of elements to rotate about their respective first axes when any one of the plurality of elements in the at least one row of elements is rotated about its first axis and that forces all elements in the at least one column of elements to rotate about their respective second axes when any one of the plurality of elements in the at least one column of elements is rotated about its second axis.

2. The puzzle of claim 1, wherein each of the plurality of elements comprises a plurality of faces and each of the plurality of faces is of a different color or design than the other of the plurality of faces on that one of the plurality of elements.

3. The puzzle of claim 1, wherein each of the plurality of elements comprises a sphere having an outer surface.

4. The puzzle of claim 1, wherein the linkage structure comprises at least one row gear having an array of teeth, each row gear is located between two adjacent elements of the at least one row of elements, and the array of teeth of the row gear engage the first array of co-planar holes of both of the two adjacent elements of the at least one row of elements.

5. The puzzle of claim 4, wherein the linkage structure comprises at least one column gear having an array of teeth, each row gear is located between two elements of the at least one column of elements, and the array of teeth of the column gear engage the first array of co-planar holes of both of the two elements of the at least one column of elements.

6. The puzzle of claim 5, wherein the at least one row gear includes an axle about which the at least one row gear rotates and wherein the at least one column gear includes an axle about which the at least one column gear rotates.

7. The puzzle of claim 5, wherein non-rotational movement of the at least one row gear and the at least one column gear is restrained by the case, rotational movement of the at least one row gear is restricted to a single axis of rotation and rotational movement of the at least one column gear is restricted to a single axis of rotation, and the axis of rotation of each of the at least one row gear is perpendicular to the axis of rotation of each of the at least one column gear.

8. The puzzle of claim 7, wherein the axis of rotation of each of the at least one row gear is co-planar to the axis of rotation of each of the at least one column gear.

9. The puzzle of claim 1, wherein the case includes top and bottom halves and a pair of opposing top and bottom openings through which each element protrudes.

10. The puzzle of claim 1, wherein each sphere element is visible from outside the case and can be manipulated from outside the case.

11. The puzzle of claim 1, wherein the first axis of each of the plurality of elements is co-planar to the first axis of every other of the plurality of elements and the second axis of each of the plurality of elements is planar to the second axis of every other of the plurality of elements.

12. The puzzle of claim 2, wherein the plurality of faces of each of the plurality of elements consists of six faces.

13. An element of a puzzle comprising:

six interlocking parts including first, second, third and fourth quads, a front end and a rear end;

each of the first, second, third and fourth quads comprising:

a face;

a deck;

a pair of blades that are parallel, spaced apart and protrude from the deck, each blade of the pair of blades includes a transverse hole extending therethrough; and a pair of bridges outboard of the pair of blades, each bridge of the pair of bridges extending to a vertex and including a transverse hole therethrough; each of the front and rear ends comprising:

a face;

a deck; and four parallel pins extending from the deck;

wherein the transverse holes of the pair of bridges of each of the first, second, third and fourth quads align with the transverse holes of the pair of bridges of the first, second, third and fourth quads to define four locking channels into which one of the four pins of each of the front and rear ends extends when the first, second, third and fourth quads, front end, and rear end are assembled.

14. The clement of claim 13, wherein the face of each of the first, second, third and fourth quads, the front end and the rear end form a spherical outer surface when the first, second, third and fourth quads, the front end and the rear end are assembled.

15. The element of claim 13, wherein the pair of blades of each respective quad is oriented so that the pairs of blades of each respective quad nest with the pairs of blades of the other quads when the first, second, third and fourth quads are assembled.

16. A puzzle comprising:

a plurality of elements arranged to define at least one row of elements and at least one column of elements, each of the plurality of elements having an outer surface and being rotatable about a first axis and a second axis, the first axis of each of the plurality of elements being parallel to the first axis of every other of the plurality of elements, the second axis of each of the plurality of elements being parallel to the second axis of every other of the plurality of elements, each of the elements including first and second planar arrays, each of the first and second planar arrays comprising a plurality of holes located on the outer surface;

a case that restrains non-rotational movement of each of the plurality of elements; and at least one row gear providing a mechanical link between each of the elements in each row, so that when any one of the elements in the row of elements is rotated about the first axis, all other elements in that row are forced to rotate about their respective first axes; and at least one column gear, one column gear of the at least one column gear being located between each of the elements in each column, so that when any one of the elements in a column is rotated about the second axis, all other elements in that column are forced to rotate about their respective second axes;

wherein the at least one row gear and at least one column gear each include a plurality of teeth, the plurality of teeth of each gear being fewer than the plurality of holes of each of the first and second planar arrays.

17. The puzzle of claim 1, wherein each of the elements further comprises a third array of co-planar holes that is perpendicular to the first array of co-planar holes and the second array of co-planar holes, the co-planar holes of the third array of co-planar holes comprising center holes located at an intersection of the third array of co-planar holes and one of the first and second arrays of co-planar holes, and a least one field hole located along only the third array of co-planar holes.

* * * * *